US007237288B2

(12) United States Patent
Lemire et al.

(10) Patent No.: US 7,237,288 B2
(45) Date of Patent: Jul. 3, 2007

(54) INDEPENDENT FOWLER AND SIDERAIL FRAMES

(75) Inventors: Guy Lemire, Beaumont (CA); Marco Morin, Levis (CA); Richard Pare, Quebec (CA)

(73) Assignee: Stryker Corporation, Kalamazoo, MI (US)

( * ) Notice: Subject to any disclaimer, the term of this patent is extended or adjusted under 35 U.S.C. 154(b) by 19 days.

(21) Appl. No.: 11/001,522

(22) Filed: Dec. 1, 2004

(65) Prior Publication Data

US 2006/0112488 A1 Jun. 1, 2006

(51) Int. Cl.
*A61G 7/015* (2006.01)

(52) U.S. Cl. ..... 5/617; 5/600

(58) Field of Classification Search ..... 5/617, 5/600, 618, 613, 616
See application file for complete search history.

(56) References Cited

U.S. PATENT DOCUMENTS 5,628,078 A * 5/1997 Pennington et al. ..... 5/618
5,926,876 A * 7/1999 Haigh et al. ..... 5/617
6,357,065 B1 * 3/2002 Adams ..... 5/618
6,678,908 B2 * 1/2004 Borders et al. ..... 5/691
6,721,975 B1 4/2004 Lemire
2006/0059624 A1 * 3/2006 Poulos et al. ..... 5/618

OTHER PUBLICATIONS

Co-pending U.S. Appl. No. 10/902,519, filed Jul. 29, 2004, Titled: Patient Support Deck Lifting/Lowering Assembly, Applicant: Guy Lemire.
Co-pending U.S. Appl. No. 10/767,240, filed Jan. 28, 2004, Titled: Siderail Mounting Assembly; Applicant: Marco Morin.

* cited by examiner

*Primary Examiner*—Alexander Grosz
(74) *Attorney, Agent, or Firm*—Van Dyke, Gardner, Linn & Burkhart, LLP

(57) ABSTRACT

A patient support apparatus which includes a litter frame having a head end and a foot end and a pair of laterally spaced, longitudinally extending support rails. A seat section which includes a seat frame is secured to the support rails. A first head section which includes a first frame is movably supported on the support rails between a first horizontal position and a second position wherein a head end of the first frame is elevated above a foot end of the first frame. The foot end of the first head section is always oriented on the litter frame immediately adjacent a head end of the seat frame. A second head section is provided on the litter frame and is separate from the first head section. The second head section includes a second frame movably supported on the support rails between a first horizontal position and a second position wherein a head end of the second frame is elevated above a foot end of the second frame. The foot end the second head section is always oriented on the litter frame immediately adjacent the head end of the seat frame.

38 Claims, 11 Drawing Sheets

FIG. 8
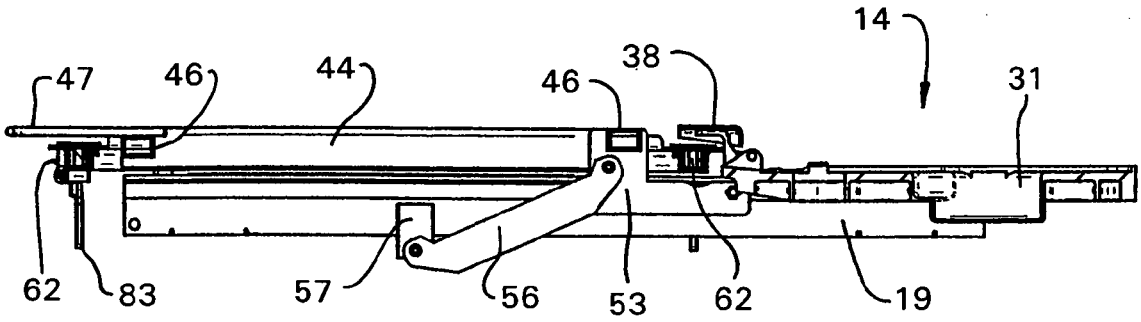
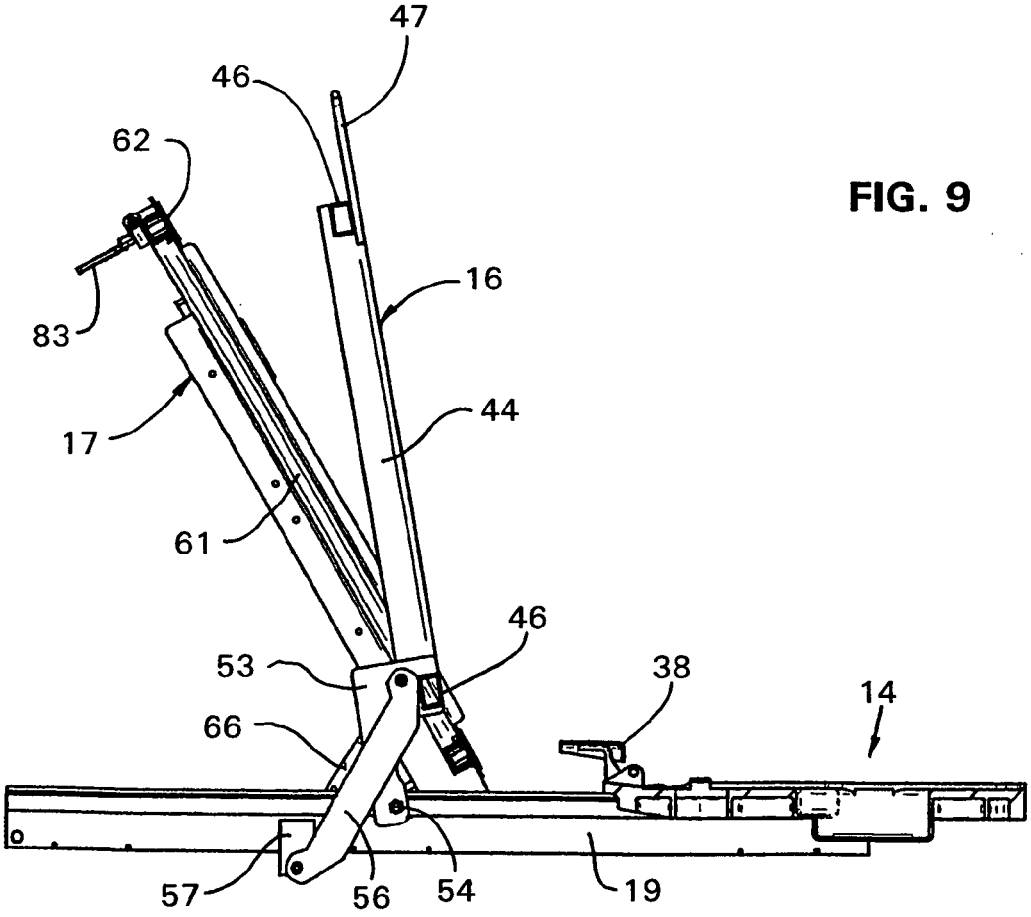
FIG. 9

FIG. 10
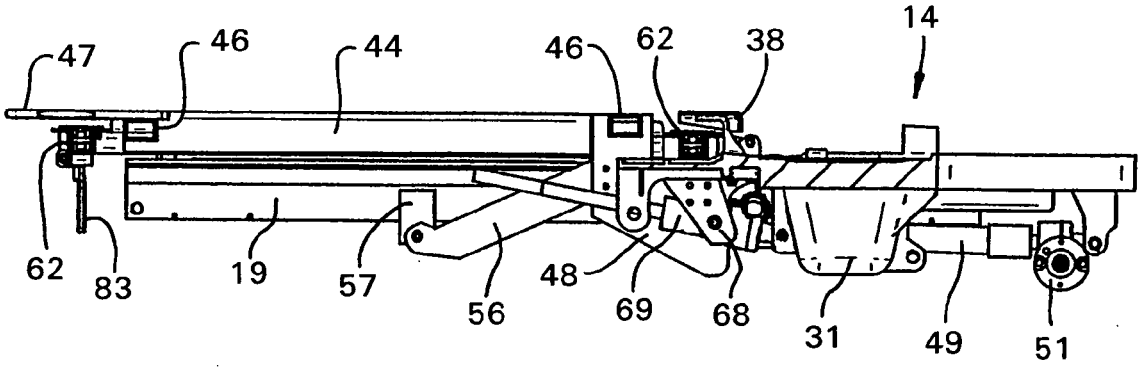
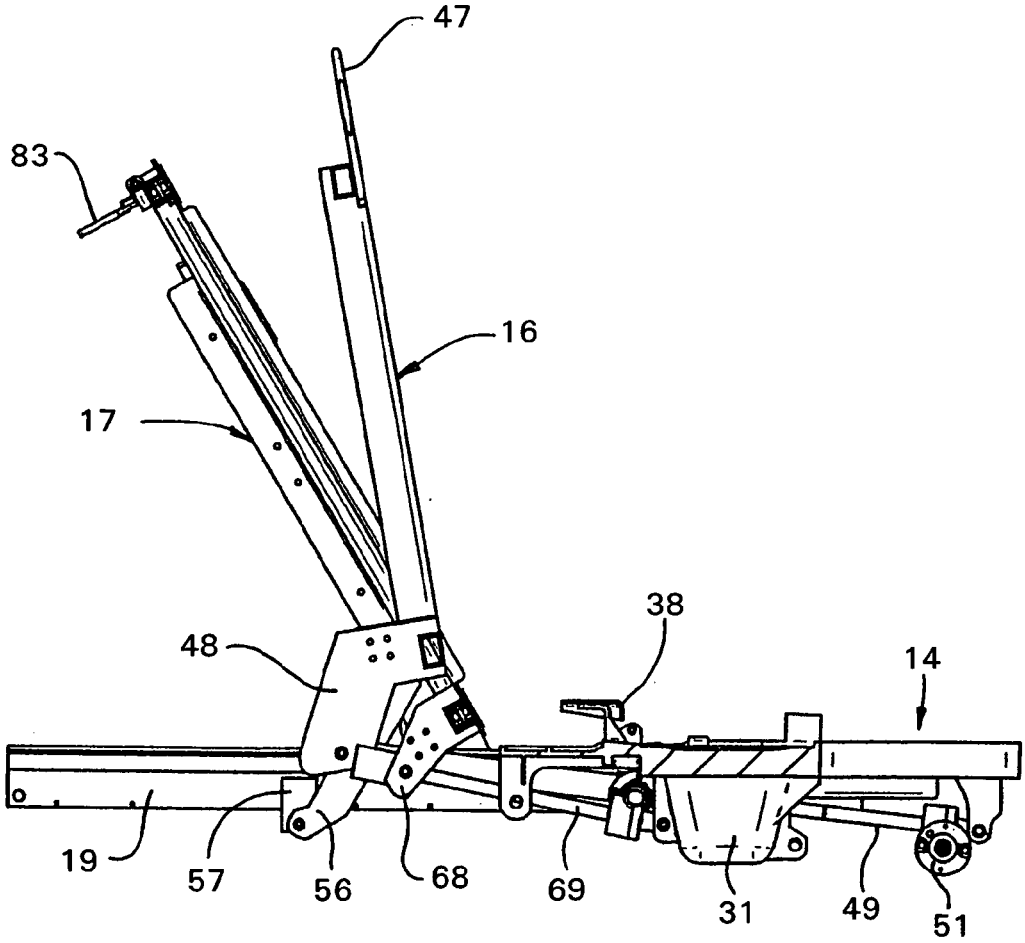
FIG. 11

FIG.12
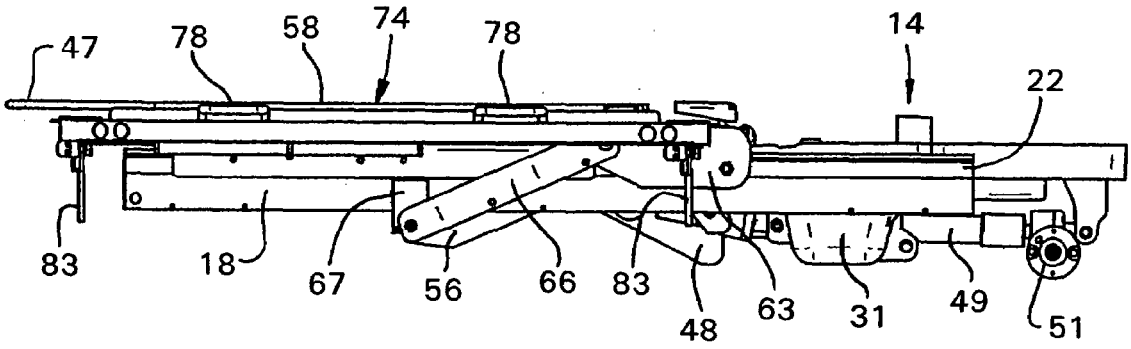
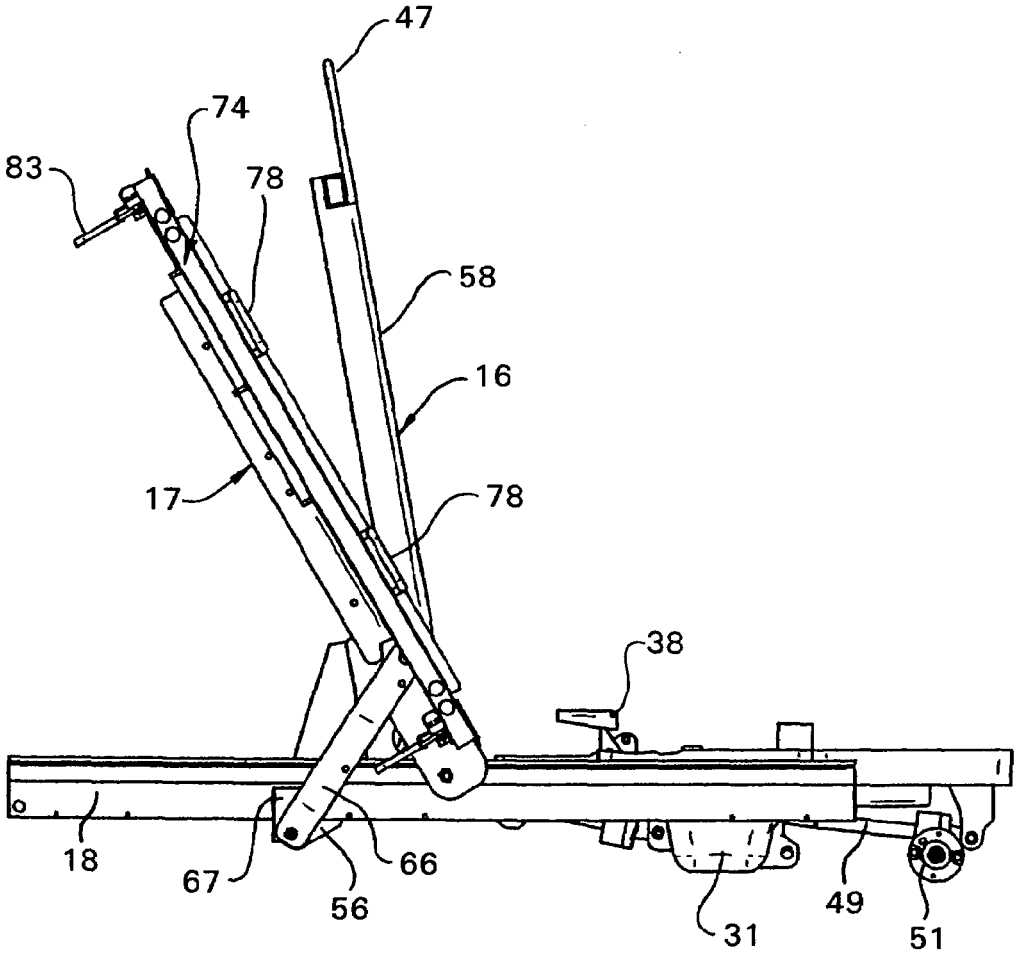
FIG. 13

INDEPENDENT FOWLER AND SIDERAIL FRAMES

FIELD OF THE INVENTION

This invention relates to a patient support apparatus and, more particularly, to a patient support apparatus having a litter frame with first and second head sections separate from one another mounted on the litter frame and being movable independently of one another, one of the two head sections having siderails and/or an extension feature mounted thereon.

BACKGROUND OF THE INVENTION

A provision of a siderail feature on a patient support apparatus is well known. In addition, the provision of an extension feature on a patient support apparatus is also well known in the art. The siderail feature and the extension feature have heretofore been mounted on laterally opposite sides of the bed and, at the head end of the litter frame, the siderail support mechanism and the extension support mechanism have been mounted on a common frame which also supports a patient support deck. The weight of the patient combined with the weight of the siderail support mechanism as well as the extension support mechanism is substantial and necessitates the use of large and heavy actuators to accommodate the movement of the head section relative to the litter frame. It is desirable to provide to the industry a patient support apparatus that is lighter in weight and, therefore, more easily manipulatable in a patient care setting.

In addition, when the siderails are mounted on the patient supporting head section and movable therewith, a gap is created, when the head section is elevated and the siderails are deployed, between the lower edge of the siderail at the head end thereof and the head board of the bed frame which potentially becomes a safety hazard if a limb of the patient happens to be in this location at the time the head section is lowered. Thus, it is desirable to mount the siderail on a bed component that is independent of the patient supporting head section.

Accordingly, it is an object of the invention to provide a patient support apparatus wherein two independent head sections are provided on the litter frame, each being movable independently of one another, with one of the frames supporting the siderail support mechanism and/or an extension support mechanism.

It is a further object of the invention to provide a patient support apparatus, as aforesaid, wherein the separate head sections are movable relative to the litter frame by separate actuators.

It is a further object of the invention to provide a patient support apparatus, as aforesaid, wherein one of the head sections on the litter frame provides the sole support for the patient while the other independent head section solely supports the siderail support mechanism and/or the extension support mechanism.

SUMMARY OF THE INVENTION

The objects and purposes of the invention, including those set forth above, are met according to one form of the invention by providing a patient support apparatus which includes a litter frame having a head end and a foot end and a pair of laterally spaced, longitudinally extending support rails. A seat section which includes a seat frame is secured to the support rails. A first head section which includes a first frame is movably supported on the support rails between a first horizontal position and a second position wherein a head end of the first frame is elevated above a foot end of the first frame. The foot end of the first head section is always oriented on the litter frame immediately adjacent a head end of the seat frame. A second head section is provided on the litter frame and is separate from the first head section. The second head section includes a second frame movably supported on the support rails between a first horizontal position and a second position wherein a head end of the second frame is elevated above a foot end of the second frame. The foot end the second head section is always oriented on the litter frame immediately adjacent the head end of the seat frame.

BRIEF DESCRIPTION OF THE DRAWINGS

Other objects and purposes of the invention will be apparent to persons acquainted with apparatus of this general type upon reading the following specification and inspecting the accompanying drawings, in which:

FIG. 8 is a sectional view taken along the line VIII—VIII of FIG. 4;

FIG. 9 is a sectional view taken along the line IX—IX of FIG. 5;

FIG. 10 is a sectional view taken along the line X—X of FIG. 4;

FIG. 11 is a sectional view taken along the line XI—XI of FIG. 5;

FIG. 12 is a lateral side elevational view of FIG. 2;

FIG. 13 is a lateral side elevational view of FIG. 2 after the patient supporting head section and extension head section have been moved to an elevated position;

DETAILED DESCRIPTION

Figure 1:
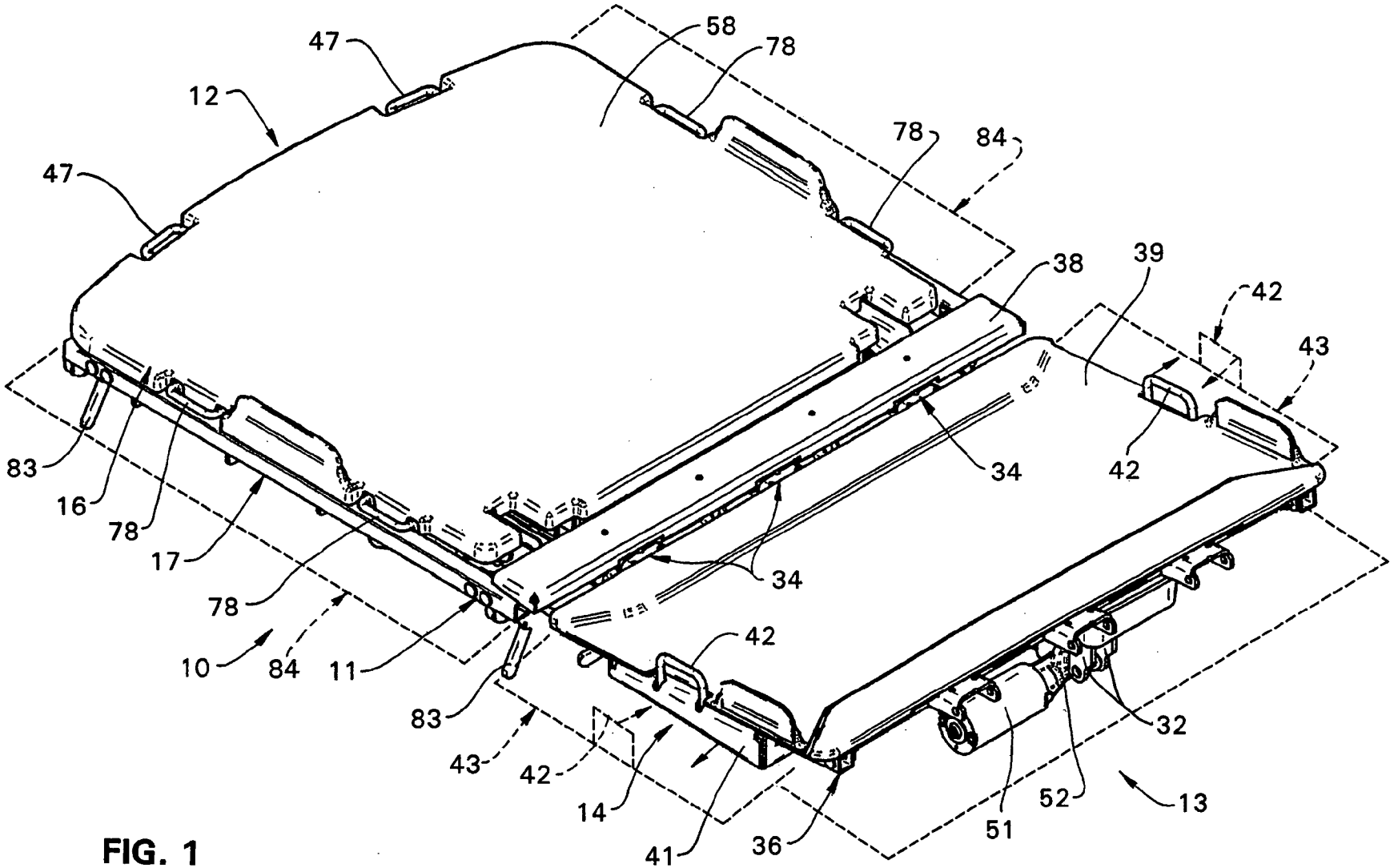
FIG. 1 is an isometric view of the seat section and dual head sections of a patient support apparatus embodying the invention.

Certain terminology will be used in the following description for convenience in reference only and will not be limiting. The words "up", and "down", "right" and "left" will designate directions in the drawings to which reference is made. The words "in" and "out" will refer to directions toward and away from, respectively, the geometric center of the patient support apparatus and designated parts thereof. Such terminology will include derivatives and words of similar import.

In addition, the term "actuator" used in the following text is intended to embrace a variety of devices for effecting movement of bed componentry relative to the frame. Specifically included within the scope of the meaning of the term "actuator" are all types of mechanical, electromechanical, hydraulic and pneumatic actuators or drives, including manual cranking mechanisms.

FIG. 1 illustrates a patient support apparatus 10 embodying the invention. The patient support apparatus 10 includes a litter frame 11 having a head end 12 and a foot end 13. The litter frame 11 has a seat section 14 and two separate head sections 16 and 17 provided thereon. While only the seat section 14 and the first head section 16 and second head section 17 are illustrated in the drawings, it being understood by those in the art that the patient support apparatus includes a foot section not illustrated.

The litter frame 11 includes a pair of longitudinally extending, laterally spaced, support rails 18 and 19. In this particular embodiment, each of the support rails 18 and 19 has an inverted U-shaped configuration as well as a pair of longitudinally extending tracks 21 and 22 on opposite laterally facing sides thereof. Each of the tracks 21 and 22 has an outwardly opening U-shaped configuration. That is, the track 21 includes a top wall 23, a bottom wall 24 and an interconnecting vertically upright wall 26 interconnecting the top wall 23 and the bottom wall 24 at the edges thereof adjacent the geometric center of each of the support rails 18 and 19. The track 21 opens laterally outwardly away from the geometric center of the litter frame 11. On the other hand, the track 22 has a U-shaped configuration opening inwardly toward the geometric center of the litter frame 11. The track 22 also has a top wall 23A, a bottom wall 24A and a vertically upright side wall 26A interconnecting the top wall 23A and the bottom wall 24A adjacent the geometric center of each of the support rails 18 and 19.

The support rails 18 and 19 are configured to be supported on the elevatable frame illustrated in co-pending application Ser. No. 10/902,519, filed on Jul. 29, 2004. The subject matter of the aforementioned pending application is incorporated herein by reference.

Figure 6:
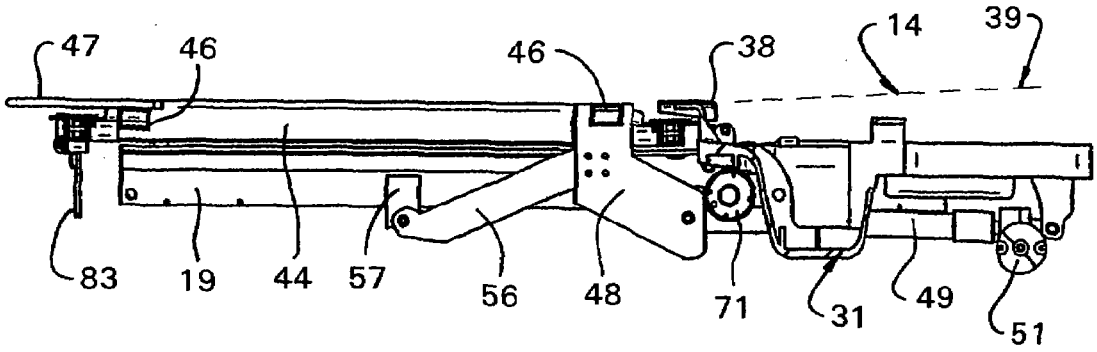
FIG. 6 is a sectional view taken along the line VI—VI of FIG. 4.
Figure 7:
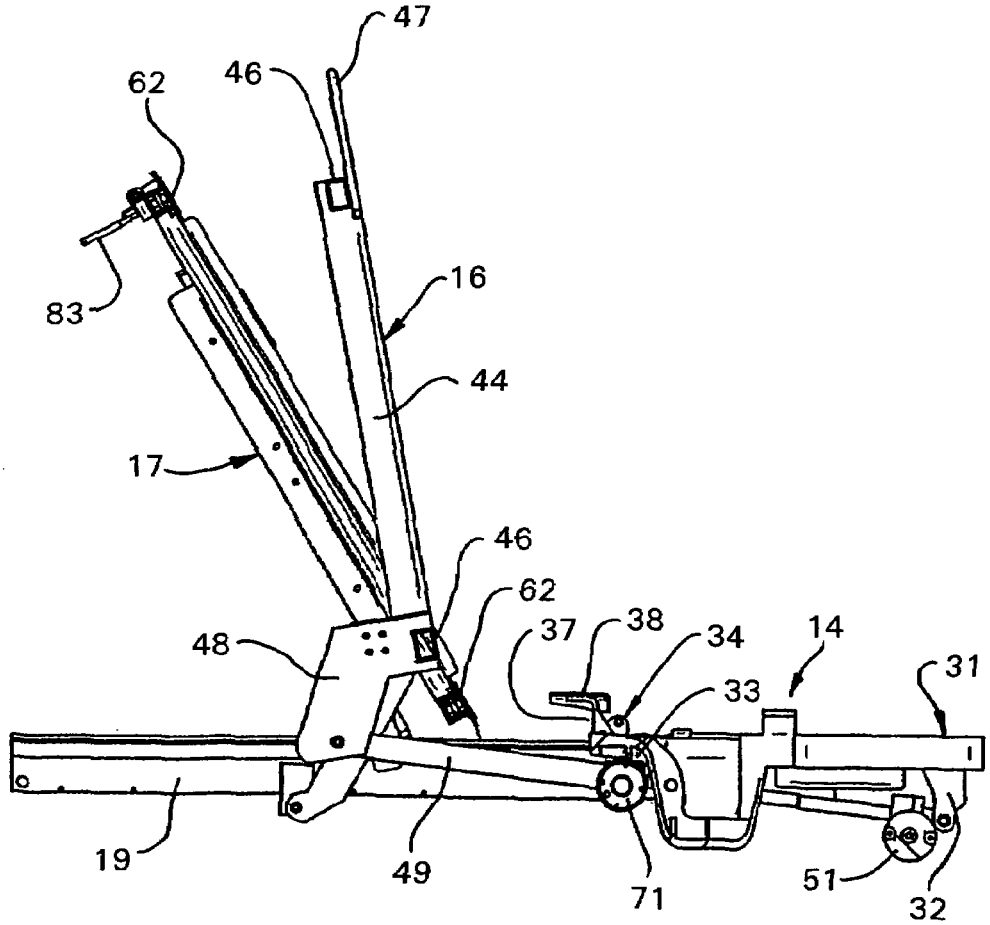
FIG. 7 is a sectional view taken along the line VII—VII of FIG. 5.

The seat section 14 includes an actuator mounting frame 31 that is secured to and extends between the support rails 18 and 19. The actuator mounting frame 31 includes a first mounting arrangement 32 depending therefrom adjacent the foot end edge thereof. A second mounting arrangement 33 depends from the actuator mounting frame 31 adjacent the head end edge thereof. On the upper side of the actuator mounting frame 31 (FIG. 2), there is provided a plurality of laterally spaced pivot supports 34 to which is secured a seat frame 36. In this particular embodiment, the seat frame 36 is pivotal about a laterally extending pivot axis of the pivot supports 34 so that the foot end of the seat section 14 can be raised to a position above the head end thereof. An actuator (not illustrated) extends between the actuator mounting frame 31 and the seat frame 36 to effect the aforesaid pivotal movement in a well known manner. A set of laterally spaced brackets 37 (FIGS. 6–15) are secured to the actuator mounting frame 31 adjacent the head end thereof and project upwardly therefrom. A partial patient support deck member 38 is secured to the upper ends of each of the brackets 37. Referring to FIG. 1, the seat frame 36 has a patient support deck member 39 secured thereto and is moveable therewith. The upwardly facing surfaces of the patient support deck members 38 and 39 can be co-planar when the patient support deck member 39 is oriented in the horizontal position illustrated in FIG. 1. However, in this particular embodiment, the patient support deck 39 is inclined to the horizontal in the range of 0° to 10°, preferably at 6° as shown in broken lines in FIG. 6.

The seat frame 36 includes an additional support frame 41 (FIG. 1) secured to each lateral side of the seat frame 36 and includes an upwardly extending handle 42 thereon. Each additional support frame 41 is supported for lateral movement with respect to the seat frame 36 in a well known manner so that the overall width of the seat frame 36 can be laterally extended from the position illustrated in FIG. 1 to the broken line illustrated positions 43 also illustrated in FIG. 1. When the additional support frames 41 have been moved laterally outwardly to the broken line illustrated positions illustrated in FIG. 1 at 43, the seat section will accommodate an extension mode. A set of conventional siderails can also be secured to the additional support frame 41 and be moveable laterally therewith and be capable of being stowed in a lowered position as well as deployed to a raised position in a conventional manner such as disclosed in U.S. Pat. No. 6,721,975 and/or U.S. Pat. No. 6,938,289, the subject matters of which are incorporated herein by reference.

Figure 3:
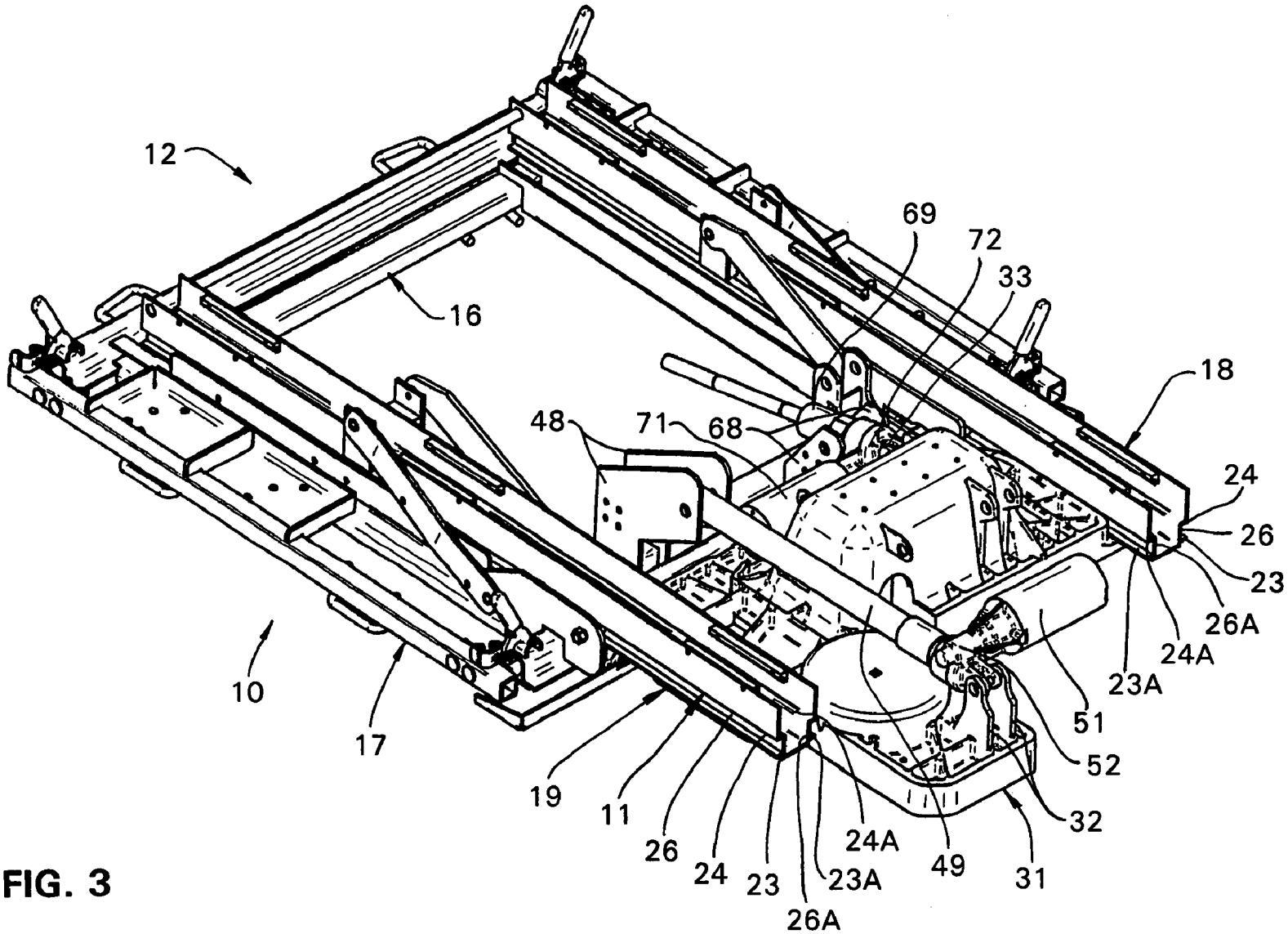
FIG. 3 is an isometric view of the underside of the seat section and dual head sections illustrated in FIG. 2.
Figure 14:
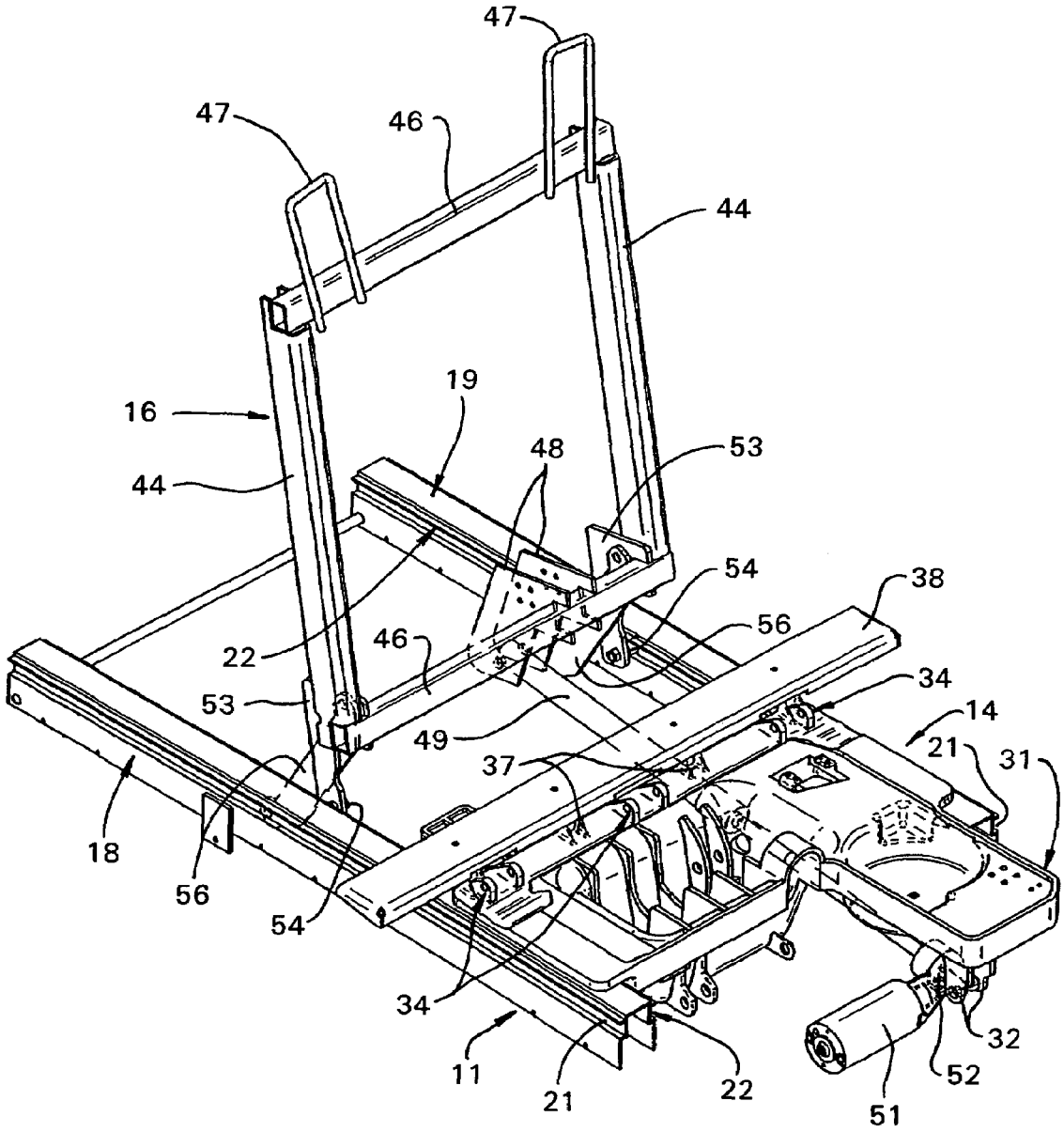
FIG. 14 is an isometric view of the patient supporting head section in an elevated position and without the presence of the extension head section.
Figure 15:
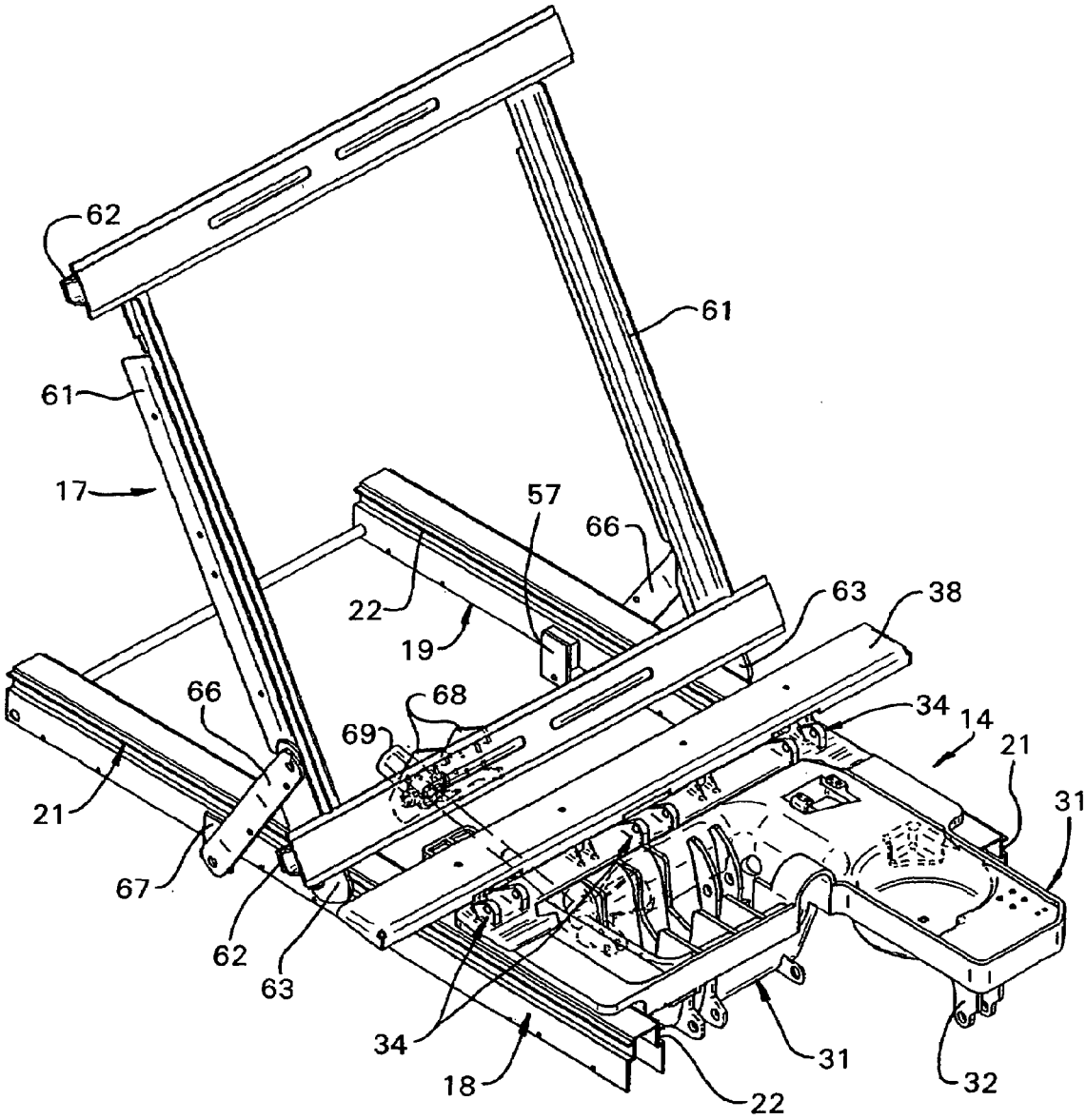
FIG. 15 is an isometric view of the extension head section in an elevated position and without the presence of the patient supporting head section.

Referring to FIG. 14, the first head section 16 includes a pair of longitudinally extending frame members 44 and a pair of laterally extending frame members 46 interconnecting the respective head ends and the foot ends of the longitudinally extending frame members 44 so as to define a rectangle. The laterally extending frame members 46 located at the head end of the head section 16 has a pair of handles 47 secured thereto and moveable therewith. An actuator mounting bracket 48 is secured to the foot end laterally extending frame member 46 and is longitudinally aligned with the first mounting arrangement 32 illustrated in FIG. 3. An extendable and retractable actuator 49 is secured to and extends between the first mounting arrangement 32 and the actuator bracket 48. In this particular embodiment, each end of the actuator 49 is pivotally secured to the respective first mounting arrangement 32 and actuator mounting bracket 48. In addition, the actuator 49 supports an electric motor 51 as well as a right angle drive mechanism 52 to facilitate the aforesaid extension and retraction feature of the actuator 49.

A pair of brackets 53 extend toward the foot end from the foot end of the first head section 16, are fixedly secured to the foot end laterally extending frame member 46 and include at the distal ends thereof a track follower mechanism 54. Each track mechanism 54 is, in this particular embodiment, a roller that is received in each of the respective laterally inwardly facing tracks 22 between the top walls 23A and bottom walls 24 thereof. A linkage member 56 is secured to each of the brackets 53 adjacent the foot end laterally extending frame member 46 at one end and to a bracket 57 (FIG. 15) secured to the laterally inside facing surface of each of the respective support rails 18 and 19 at the other end thereof. As a result, when the motor 51 effects a lengthening of the actuator 49, the length of the linkage members 56 will determine the extent to which the foot end of the first head section 16 moves toward the head end 12 of the litter frame 11, it being understood that the track follower mechanisms 54 guided in the respective laterally inwardly facing tracks 22 will serve to control the first head section 16 as it moves from the horizontal position illustrated in FIG. 1 to positions at and between the fully upright position in FIGS. 7, 9, 11 and 13.

A patient support deck member 58 (FIG. 1) is secured to the frame members 44 and 46 by a plurality of fasteners not illustrated.

Figure 2:
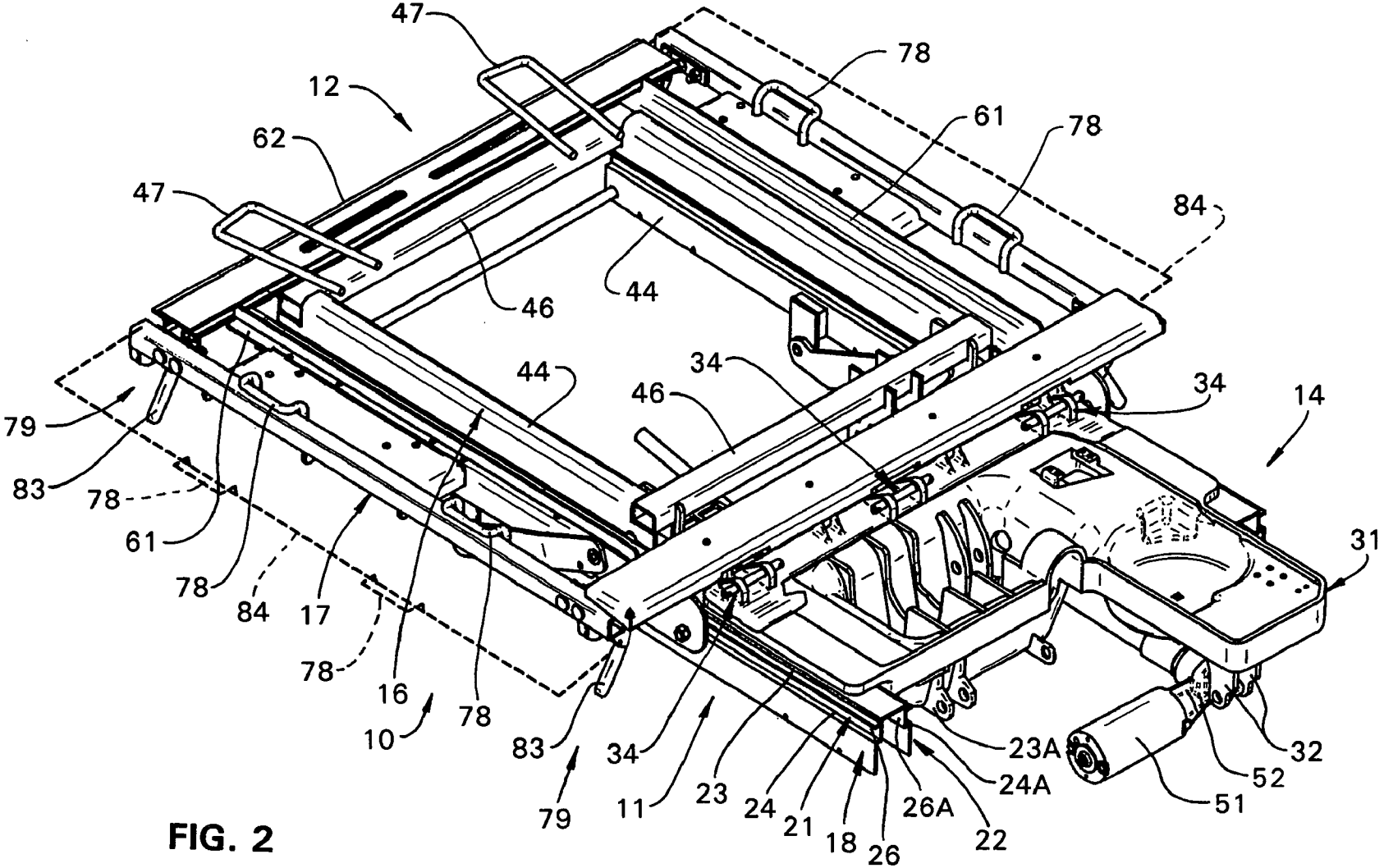
FIG. 2 is an isometric view of the seat section and dual head sections according to FIG. 1 and with the patient support decking removed.

The second head section 17 includes a pair of longitudinally extending frame members 61 and a pair of laterally extending frame members 62 secured to the respective head end and foot end of the longitudinally extending frame members 61 to define a rectangle. The lateral width and length of the rectangle is larger than the rectangular frame defined by the frame members 44 and 46 so that the first head section 16 will be capable of being oriented inside the rectangle defined by the frame members 61 and 62 as illustrated in FIG. 2. The laterally extending frame members 62 are identical to one another and have a tubular configuration opening laterally outwardly at the opposite lateral ends thereof. A pair of brackets 63, extend toward the foot end from the second head section, are fixedly secured to the foot ends of each of the longitudinally extending frame members 61 and include at the distal ends thereof a track follower mechanism 64 (FIG. 2) received in each of the respective laterally outwardly facing tracks 21 on the support rails 18 and 19. In this particular embodiment, each track follower mechanism 64 is a roller configured to roll between the top wall 23, 23A, and 24, 24A of each of the respective tracks 21. A linkage member 66 is secured to each of the longitudinally extending frame members 61 at one end and to a bracket 67 fixedly secured to the laterally outside facing surfaces of the support rails 18 and 19 at the other end.

A further bracket 68 is secured to the foot end laterally extending frame member 62 and is longitudinally aligned with the second mounting arrangement 33 provided on the actuator mounting frame 31. An extendable and retractable actuator 69 is pivotally secured to and extends between the second mounting arrangement 33 and the bracket 68. The actuator 69 includes an electric motor 71 and a right angle drive mechanism 72 in order to facilitate the extending and contracting feature of the actuator 69. Thus, as the actuator 69 extends and retracts, the second head section 17 will move to and between the horizontal position illustrated in FIG. 2 and the elevated position illustrated in FIGS. 7, 9, 11 and 13. The length of the linkage members 66 and the length of the linkage members 56 will prevent the first and second head sections 16 and 17 from interfering with one another during their movement between the respective horizontal positions and elevated positions.

In this particular embodiment, the first head section 16 is moveable to and between a horizontal position and a position inclined at 75 to 90 degrees, preferably 80 degrees to the horizontal. The second head section 17 is moveable to and between a horizontal position and an inclined position at 55 to 70 degrees, preferably 60 degrees relative to the horizontal. The reason for this differential in movement of the two head sections 16 and 17 is to enhance the view of the patient past the deployed siderails when the first head section 16 is elevated to its uppermost position to thereby enable the patient to be able to look left and right without the interference from the deployed siderails.

Figure 4:
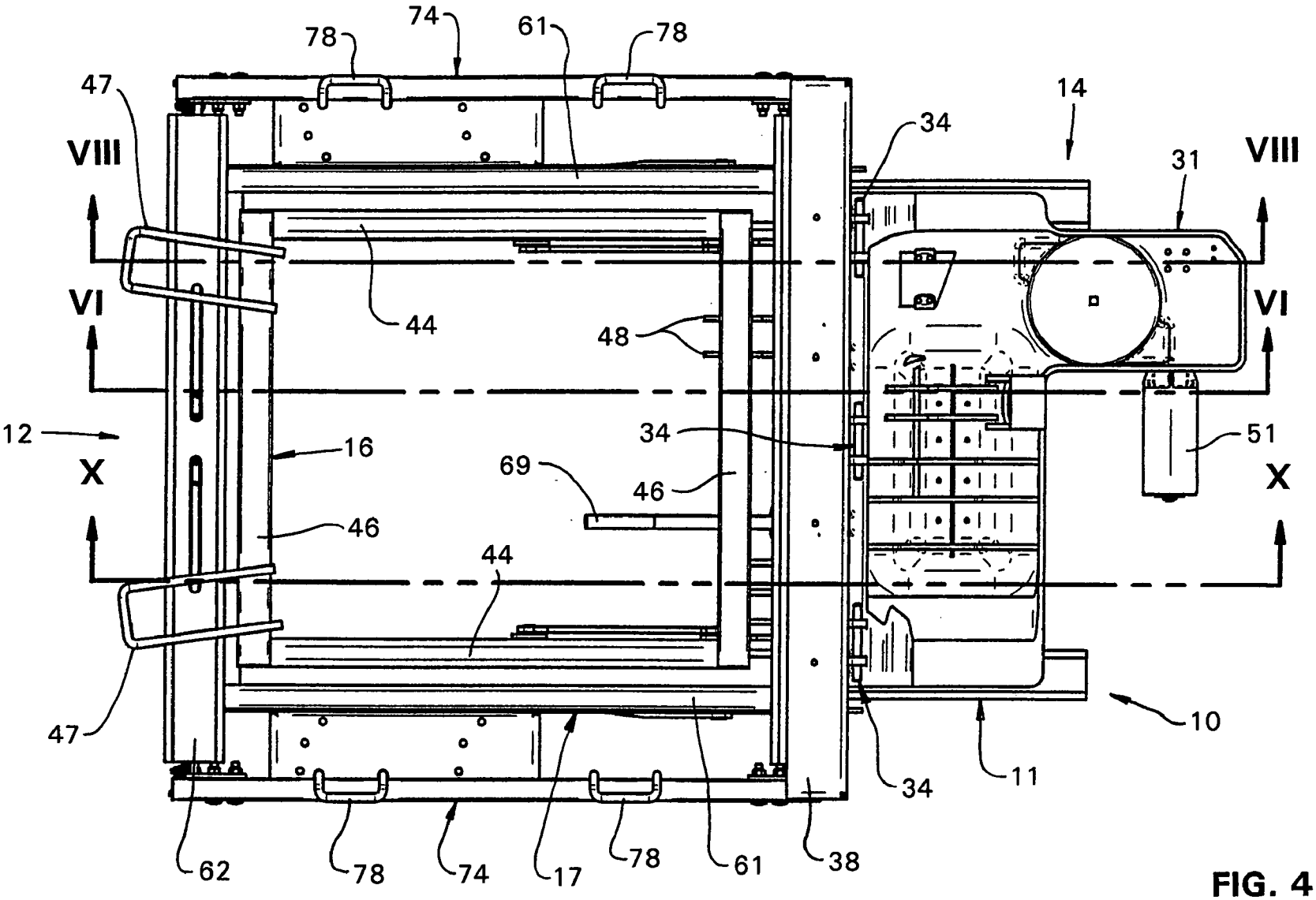
FIG. 4 is a top view of the seat section and dual head sections illustrated in FIG. 2.
Figure 5:
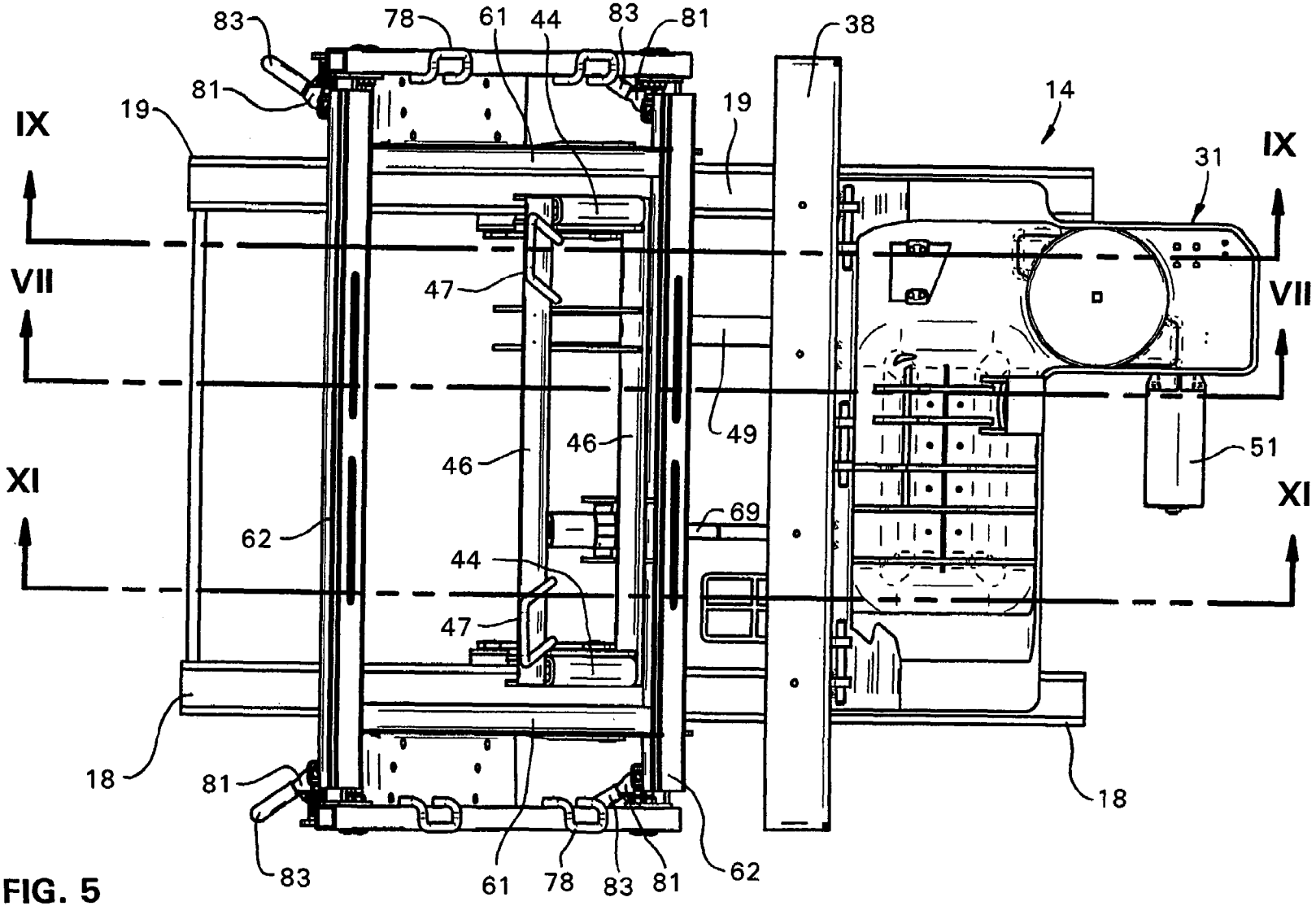
FIG. 5 is a top view of the seat section and dual head sections after the patient supporting head section and extension head section have been moved to an elevated position.

A pair of further support frames 74 (FIGS. 2 and 4) are supported on the second head section and particularly on the laterally extending frame members 62. That is, the further support frames 74 each include a longitudinally extending frame member 76 and a pair of laterally extending frame members 77 secured at one end thereof to the opposite longitudinal ends of the frame member 76. The lateral extending frame members 77 are configured to be received into the hollow interior of the frame members 62 and be supported for relative sliding movement therein. A pair of longitudinally spaced patient restraint brackets 78 are secured to the longitudinally extending frame member 76 and these mattress restraint brackets can be utilized to facilitate the attendant's grasping of them to pull the further support frames 74 laterally outwardly to the broken line position illustrated at 84 in FIG. 2.

Each of the further support frames 74 includes a pair of longitudinally spaced latching devices 79 for locking the further support frames to the rectangular frame defined by the frame members 61 and 62. Each latching device 79 (FIG. 3) includes a two arm lever 81 pivotally secured mid-length thereof to the further support frame 74. One end of the two arm lever 81 includes a latching arm 82 (FIG. 3) receivable into a corresponding recess 82A in the laterally extending frame members 62 to latch the further support frames to the second head section 17. The other arm of the two arm lever defines a handle 83 which is configured to be manually grasped by the attendant to effect a release of the latching devices to facilitate movement of the further support frames 74 between the solid line position illustrated in FIG. 2 and the broken line position 84 also illustrated in FIG. 2. A set of conventional siderails can also be secured to the further support frames 74 and be moveable laterally therewith and be capable of being stowed in a lowered position as well as deployed to a raised position in a conventional manner such as disclosed in U.S. Pat. No. 6,721,975 and/or U.S. Pat. No. 6,938,289, the subject matters of which are incorporated herein by reference. In addition, a latching device 79A (FIG. 1) identical to the latching device 79 can be employed to latch the additional support frame 41 to the seat frame 36.

Although a particular preferred embodiment of the invention has been disclosed in detail for illustrative purposes, it will be recognized that variations or modifications of the disclosed embodiment, including the rearrangement of parts, lie within the scope of the present invention.

What is claimed is:

1. A patient support apparatus, comprising:

a litter frame having a head end and a foot end and including a pair of laterally spaced, longitudinally extending support rails;

a seat section including a seat frame secured to said support rails;

a first head section including a first frame moveably supported on said support rails between a first horizontal position and a second position wherein a head end of said first frame is elevated above a foot end of said first frame, said foot end of said first head section always being oriented on said litter frame immediately adjacent a head end of said seat frame; and a second head section separate from said first head section and including a second frame moveably supported on said support rails between a first horizontal position and a second position wherein a head end of said second frame is elevated above a foot end of said second frame, said foot end of said second head section always being oriented on said litter frame immediately adjacent said head end of said seat frame.

2. The patient support apparatus according to claim 1, wherein said first frame includes a patient support deck member mounted thereon.

3. The patient support apparatus according to claim 1, wherein said seat frame includes a patient support deck member mounted thereon.

4. The patient support apparatus according to claim 1, wherein said second frame includes at least one further support frame and a support mechanism supporting said further support frame for movement laterally of said second frame and between a first stowed position wherein said further support frame and said second frame have a combined first lateral width dimension and a second deployed position wherein said further support frame and said second frame have a combined second lateral width dimension greater than said first lateral width dimension.

5. The patient support apparatus according to claim 4, wherein said seat frame has a third lateral width dimension generally equal to said first lateral width dimension.

6. The patient support apparatus according to claim 1, wherein each of said laterally spaced, longitudinally extending support rails includes a first guide track extending coextensively with said support rails.

7. The patient support apparatus according to claim 6, wherein said first frame includes first and second laterally spaced track followers operatively guided for movement along a respective one of said first guide tracks, said first and second track followers being oriented adjacent said foot end of said first frame, and first and second laterally spaced linkage members each having one end thereof moveably connected to said first frame and a second end thereof moveably connected to a respective one of said support rails.

8. The patient support apparatus according to claim 6, wherein each of said laterally spaced, longitudinally extending support rails includes a second guide track extending coextensively with said support rails.

9. The patient support apparatus according to claim 8, wherein said second frame includes third and fourth laterally spaced track followers operatively guided for movement along a respective one of said second guide tracks, said third and fourth track followers being oriented adjacent said foot end of said second frame, and third and fourth laterally spaced linkage members each having one end thereof moveably connected to said second frame and a second end thereof moveably connected to a respective one of said support rails.

10. The patient support apparatus according to claim 8, wherein said first and second guide tracks on said support rails extend parallel to one another.

11. The patient support apparatus according to claim 8, wherein said support rails extend parallel to one another, said first guide tracks on each of said support rails being oriented on an inside facing part of said support rails so that they oppose one another, and said second guide tracks on each of said support rails being oriented on an outside facing part of said support rails so that they face away from one another.

12. The patient support apparatus according to claim 7, wherein said first and second linkage members are each oriented laterally to the inside of and intermediate said support rails, and wherein said third and fourth linkage members are each oriented laterally to the outside of said support rails.

13. The patient support apparatus according to claim 1, wherein said first frame includes a first actuator bracket secured thereto and moveable therewith, said seat frame including a first actuator support, and a first actuator secured to and extending between said first actuator bracket and said first actuator support for effecting movement of said first frame relative to said first actuator support.

14. The patient support apparatus according to claim 13, wherein said second frame includes a second actuator bracket secured thereto and moveable therewith, said seat frame including a second actuator support, and a second actuator secured to and extending between said second actuator bracket and said first actuator support for effecting movement of said second frame relative to said first actuator support.

15. The patient support apparatus according to claim 1, wherein said first frame has a first perimeter dimension and said second frame has a second perimeter dimension greater than said first perimeter dimension.

16. The patient support apparatus according to claim 15, wherein said second frame is comprised of interconnected elongate frame components defining a rectangle, said first frame being oriented inside said rectangle when said first and second frames are in their respective horizontal positions.

17. The patient support apparatus according to claim 16, wherein said first frame includes a patient support deck member mounted thereon for movement therewith, said patient support deck member having a sufficient surface area and a first lateral width dimension to effectively overlay said first and second frames when said first and second frames are both in their respective horizontal positions.

18. The patient support apparatus according to claim 17, wherein said second frame includes at least one further support frame and a support mechanism supporting said further support frame for movement laterally of said second frame and between a first stowed position wherein said further support frame and said second frame have a combined first lateral width dimension and a second deployed position wherein said further support frame and said second frame have a combined second lateral width greater than said first lateral width dimension.

19. The patient support apparatus according to claim 18, wherein said patient support deck member on said first frame has a lateral width dimension generally equal to said first lateral width dimension.

20. The patient support apparatus according to claim 1, wherein said second frame includes at least one further support frame and a first support mechanism supporting said further support frame for movement laterally of said second frame and between a first stowed position wherein said further support frame and said second frame have a combined first lateral width dimension and a second deployed position wherein said further support frame and said second frame have a combined second lateral width dimension greater than said first lateral width dimension, said seat section having a third frame and at least one additional support frame, a second support mechanism supporting said additional support frame for movement laterally of said third frame and between a first stowed position wherein said additional support frame and said third frame have a combined third lateral width dimension and a second deployed position wherein said additional support frame and said third frame have a combined fourth lateral width dimension greater than said third lateral width dimension.

21. The patient support apparatus according to claim 20, wherein said first and third lateral width dimensions are generally equal.

22. The patient support apparatus according to claim 21, wherein said second and fourth lateral width dimensions are generally equal.

23. The patient support apparatus according to claim 20, wherein said first frame includes a first patient support deck mounted thereon, said first patient support deck having a lateral width dimension generally equal to said first lateral width dimension; and wherein said third frame includes a second patient support deck mounted thereon, said second patient support deck having a lateral width dimension generally equal to said first lateral width dimension.

24. The patient support apparatus according to claim 1, wherein said second frame includes at least one further support frame and a support mechanism supporting said further support frame for movement laterally of said second frame and between a first stowed position wherein said further support frame and said second frame have a combined first lateral width dimension and a second deployed position wherein said further support frame and said second frame have a combined second lateral width dimension greater than said first lateral width dimension, said support mechanism including at least one releasable latch device for releasably locking said at least one further support frame to said second frame.

25. The patient support apparatus according to claim 24, wherein said support mechanism includes a pair of longitudinally spaced releasable latch devices for releasably locking said at least one further support frame to said second frame.

26. The patient support apparatus according to claim 24, wherein said second frame includes plural further support frames and plural support mechanisms supporting each said further support frame for movement laterally from opposite lateral sides of said second frame and between said first stowed position wherein said plural further support frames and said second frame have a combined first lateral width dimension and a second deployed position wherein said plural further support frames and said second frame have a combined second lateral width dimension greater than said first lateral width dimension, said plural support mechanisms including at least one releasable latch device for releasably locking said plural further support frames to said second frame.

27. The patient support apparatus according to claim 1, wherein said seat section includes a third frame, said third frame including at least one additional support frame and a first support mechanism supporting said additional support frame for movement laterally of said third frame and between a first stowed position wherein said additional support frame and said third frame have a combined first lateral width dimension and a second deployed position wherein said additional support frame and said third frame have a combined second lateral width dimension greater than said first lateral width dimension, said first support mechanism including at least one releasable latch device for releasably locking said at least one additional support frame to said third frame.

28. The patient support apparatus according to claim 27, wherein said first support mechanism includes a pair of longitudinally spaced releasable latch devices for releasably locking said at least one additional support frame to said third frame.

29. The patient support apparatus according to claim 27, wherein said third frame includes plural additional support frames and plural support mechanisms supporting each said additional support frame for movement laterally from opposite lateral sides of said third frame and between said first stowed position wherein said plural further support frames and said third frame have a combined first lateral width dimension and a second deployed position wherein said plural additional support frames and said third frame have a combined second lateral width dimension greater than said first lateral width dimension, said plural support mechanisms including at least one releasable latch device for releasably locking said plural additional support frames to said third frame.

30. The patient support apparatus according to claim 1, wherein said second position of said first head section is elevated higher than said second position of said second head section.

31. The patient support apparatus according to claim 30, wherein said second position of said first head section is in the range of 75 to 90 degrees and said second position of said second head section is in the range of 55 to 70 degrees.

32. A patient support apparatus, comprising:

a litter frame having a head end and a foot end and including a pair of laterally spaced, longitudinally extending support rails;

a seat section including a seat frame secured to said support rails;

a head section including a head frame moveably supported on said support rails between a first horizontal position and a second position wherein a head end of said head frame is elevated above a foot end of said head frame;

at least one of said seat section and said head section having at least one support frame and a support mechanism supporting said at least one support frame for movement laterally of said at least one of said seat section and said head section and between a first stowed position wherein said at least one support frame and said at least one of said seat section and said head section have a combined first lateral width dimension and a second deployed position wherein said at least one support frame and said at least one of said seat section and said head section have a combined second lateral width dimension greater than said first lateral width dimension; and a latch mechanism for latching said at least one support frame to said at least one of said seat section and said head section when said at least one support frame is in said first position.

33. The patient support apparatus according to claim 32, wherein said latch mechanism includes a latch member on one of said at least one of said seat section and said head section and a latch recess on an other of said at least one of said seat section and said head section and normally inter-engaged with one another when said at least one support frame is in said first position, one of said latch member and said latch recess being moveably supported for movement toward and away from the other to effect a disengagement therebetween.

34. The patient support apparatus according to claim 33, wherein said latch recess is provided on said at least one of said seat section and said head section.

35. The patient support apparatus according to claim 33, wherein said latch member is a two arm lever pivotally supported on said at least one support frame for movement between a first position thereof and a second position thereof, one arm of said two arm lever being configured to inter-engage said latch recess when in said first position thereof to effect a locking of said at least one support frame in said first stowed position.

36. The patient support apparatus according to claim 32, wherein said seat section and said head section both have at least one support frame thereon.

37. The patient support apparatus according to claim 32, wherein said at least one of said seat section and said head section have a pair of support frames each moveably supported on opposite lateral sides thereof to effect a widening of said patient support at both lateral sides thereof.

38. The patient support apparatus according to claim 37, wherein said latch mechanism is provided for each support frame, each latch mechanism including a latch member on one of said seat section and said head section and a latch recess on an other of said seat section arid said head section and normally inter-engaged with one another when a respective support frame is in said first position, one of said latch member and said latch recess being moveably supported for movement toward and away from the other to effect a disengagement therebetween.

* * * * *

UNITED STATES PATENT AND TRADEMARK OFFICE

CERTIFICATE OF CORRECTION

PATENT NO. : 7,237,288 B2
APPLICATION NO. : 11/001522
DATED : July 3, 2007
INVENTOR(S) : Guy Lemire, Marco Morin and Richard Pare It is certified that error appears in the above-identified patent and that said Letters Patent is hereby corrected as shown below:

Column 11:
Line 3, Claim 38, "arid" should be --and--.

Signed and Sealed this

Thirteenth Day of May, 2008

JON W. DUDAS
*Director of the United States Patent and Trademark Office*